US011084693B2

(12) United States Patent
Weckbecker et al.

(10) Patent No.: US 11,084,693 B2
(45) Date of Patent: Aug. 10, 2021

(54) CRANE AND METHOD FOR INFLUENCING A DEFORMATION OF A JIB SYSTEM OF SAID CRANE

(71) Applicant: Tadano Demag GmbH, Zweibrücken (DE)

(72) Inventors: Alfons Weckbecker, Zweibrücken (DE); Frank Schnittker, Würzburg (DE)

(73) Assignee: Tadano Demag GmbH, Zweibrücken (DE)

( * ) Notice: Subject to any disclaimer, the term of this patent is extended or adjusted under 35 U.S.C. 154(b) by 0 days.

(21) Appl. No.: 16/894,009

(22) Filed: Jun. 5, 2020

(65) Prior Publication Data

US 2020/0299112 A1 Sep. 24, 2020

Related U.S. Application Data

(62) Division of application No. 15/550,981, filed as application No. PCT/EP2016/053128 on Feb. 15, 2016, now Pat. No. 10,696,526.

(30) Foreign Application Priority Data

Feb. 16, 2015 (DE) ..... 102015202734.1

(51) Int. Cl.
*B66C 23/68* (2006.01)
*B66C 23/82* (2006.01)
(Continued)

(52) U.S. Cl.
CPC ..... *B66C 23/68* (2013.01); *B66C 13/18* (2013.01); *B66C 15/00* (2013.01); *B66C 23/283* (2013.01);
(Continued)

(58) Field of Classification Search
CPC ..... B66C 23/68; B66C 23/283; B66C 23/62; B66C 23/825; B66C 23/88; B66C 23/42; B66C 13/18; B66C 15/00
See application file for complete search history.

(56) References Cited

U.S. PATENT DOCUMENTS 4,070,800 A * 1/1978 Brown ..... B66C 13/02 52/1
8,517,192 B2 8/2013 Franzen et al.
(Continued)

FOREIGN PATENT DOCUMENTS

CN 101927967 A 12/2010
CN 203095460 U 7/2013
(Continued)

OTHER PUBLICATIONS

International Search Report of the International Searching Authority from corresponding Patent Cooperation Treaty (PCT) Application No. PCT/EP2016/053128, indicated completed on Apr. 29, 2016.
(Continued)

*Primary Examiner* — Michael E Gallion
(74) *Attorney, Agent, or Firm* — Gardner, Linn, Burkhart & Ondersma LLP

(57) ABSTRACT

A crane having at least one jib system, a sensor unit for detecting a deformation of the jib system transversely to a load plane, and to an activatable adjustment unit for influencing the deformation of the jib system transversely to the load plane.

9 Claims, 8 Drawing Sheets

(51) Int. Cl.

| | |
|---|---|
| ***B66C 23/62*** | (2006.01) |
| ***B66C 23/28*** | (2006.01) |
| ***B66C 15/00*** | (2006.01) |
| ***B66C 13/18*** | (2006.01) |
| ***B66C 23/88*** | (2006.01) |
| *B66C 23/42* | (2006.01) |

(52) U.S. Cl.
CPC ..... *B66C 23/62* (2013.01); *B66C 23/825* (2013.01); *B66C 23/88* (2013.01); *B66C 23/42* (2013.01)

(56) References Cited

U.S. PATENT DOCUMENTS

| | | | | |
|---|---|---|---|---|
| 8,646,630 | B2 | 2/2014 | Franzen et al. | |
| 8,800,791 | B2 | 8/2014 | Franzen et al. | |
| 9,056,752 | B2 | 6/2015 | Müller et al. | |
| 9,090,436 | B2 | 7/2015 | Franzen et al. | |
| 10,696,526 | B2 * | 6/2020 | Weckbecker | B66C 13/18 |
| 2004/0190995 | A1 | 9/2004 | Matsushita | |
| 2005/0258122 | A1 * | 11/2005 | Morath | B66C 23/78 212/294 |
| 2010/0044332 | A1 | 2/2010 | Cameron | |
| 2015/0249821 | A1 * | 9/2015 | Tanizumi | B66C 13/00 348/46 |
| 2016/0318739 | A1 | 11/2016 | Terata | |
| 2016/0332848 | A1 | 11/2016 | Wieschemann et al. | |
| 2017/0066632 | A1 | 3/2017 | Hegewald | |
| 2018/0134528 | A1 * | 5/2018 | Oka | B66C 23/92 |
| 2019/0023539 | A1 * | 1/2019 | Yuzawa | B66C 23/36 |
| 2020/0140239 | A1 * | 5/2020 | Schoonmaker | B60R 1/00 |
| 2020/0148510 | A1 * | 5/2020 | Rauscher | B66C 13/066 |

FOREIGN PATENT DOCUMENTS

| | | | |
|---|---|---|---|
| DE | 3113763 | C2 | 9/1988 |
| DE | 20107984 | U1 | 12/2001 |
| DE | 202008006167 | U1 | 7/2008 |
| DE | 102009016033 | A1 | 1/2010 |
| DE | 202013011183 | U1 | 1/2014 |
| DE | 102013205173 | A1 | 10/2014 |
| EP | 0672889 | A2 | 9/1995 |
| EP | 2636634 | A1 | 9/2013 |
| NL | 7608585 | A | 2/1977 |

OTHER PUBLICATIONS

Written Opinon of the International Searching Authority from corresponding Patent Cooperation Treaty (PCT) Application No. PCT/EP2016/053128, indicated completed on Apr. 29, 2016.

Preliminary Report on Patentability of the International Searching Authority in English from corresponding Patent Cooperation Treaty (PCT) Application No. PCT/EP2016/053128, completed Aug. 22, 2017.

* cited by examiner

CRANE AND METHOD FOR INFLUENCING A DEFORMATION OF A JIB SYSTEM OF SAID CRANE

CROSS REFERENCE TO RELATED APPLICATIONS

The present patent application is a divisional of U.S. patent application Ser. No. 15/550,981, filed Aug. 14, 2017, which claims the priority benefits of International Patent Application No. PCT/EP2016/053128, filed Feb. 15, 2016, and claims benefit of the German patent application DE 10 2015 202 734.1, the contents of which are incorporated herein by reference.

BACKGROUND OF THE INVENTION

The invention relates to a crane and a method of influencing a deformation of a jib system of such a crane.

DE 20 2008 006 167 U1 and DE 20 2013 001 183 U1 disclose cranes comprising laterally anchored jibs. The lateral anchorings serve to reduce the deformation of the jib in a load plane or transverse thereto. DE 10 2009 016 033 A1 and DE 10 2013 205 173 A1 disclose large-scale jib constructions which permit an increase in load-bearing capacity by increasing the jib rigidity transverse to the load plane. These jib constructions take into account the effect that deformations of a compression-loaded jib result in a disproportionately large stress-loading on the components. This results in a reduction in the load-bearing capacity of the jib. In the case of the solutions previously known from the prior art, deformations of the jib are passively reduced by means of anchoring systems through the use of additional and/or superior material and/or by means of geometric load transfer, in order to increase the load-bearing capacity of the crane.

SUMMARY OF THE INVENTION

It is an object of the present invention to provide a crane having improved load-bearing capacities.

In accordance with an embodiment of the invention, it has been recognised that an activatable adjusting unit permits in particular active influencing of a deformation of a jib system transverse to the load plane. The load plane is a vertical plane. The load plane is fixed by the load application of an external load, which is to be lifted, on the jib system, in particular on a jib head element. If the crane is arranged in a planar manner on a horizontal ground surface and in particular there are no deformations on the crane, the luffing axis of the crane is oriented horizontally. A load plane is oriented perpendicularly to the luffing axis. In this case, the load plane is identical to the load plane. In the event that the crane is arranged in an inclined manner with respect to the horizontal e.g. by reason of an uneven ground surface, the load plane is different from the load plane. A crane in terms of the invention is a crane for lifting a load. The jib system includes a jib of the crane and in particular further connecting elements which connect the jib towards the crane. Such connecting elements are e.g. a rotary joint, a jib foot bolt, a luffing cylinder, lateral anchoring elements and crane components which are inwardly directed, i.e. oriented opposite to the jib, are arranged in a load plane and hold the jib in a load direction, in particular an anchoring block or superlift mast. The jib system can additionally have an auxiliary jib which is articulated to the jib in a rigid or luffable manner. The jib can consist of a plurality of jib elements which are arranged one behind the other along a jib longitudinal axis. The jib can have a jib head element, on which e.g. deflection rollers for a cable are arranged, from which a load is suspended. The jib of the crane can be a lattice mast jib or a telescopic jib or a combination thereof. The crane has in particular a long, slender jib which is expected to experience large deformations during operation. Such a jib has e.g. a ratio of length to thickness of at least 20, in particular at least 30, in particular at least 40, in particular at least 50, in particular at least 70, in particular at least 100 and in particular not more than 1000. The adjusting unit can be integrated on and/or in the jib system. In order to influence the deformation, more than one adjusting unit can also be used. It is essential that at least one adjusting unit is used. The adjusting unit is arranged in particular between two crane components. One crane component is in particular the jib system. Further crane components can be a superstructure, a lower carriage and/or a floor support unit.

A sensor unit serves to detect the deformation of the jib system and to provide the deformation information for information processing. The crane can also be provided with a plurality of adjusting units which are arranged in particular at different locations or on different crane components. A deformation of the jib system in terms of the invention is understood to be any arrangement of the jib system deviating from a desired state. A desired state of the jib system is achieved e.g. when the jib is oriented vertically with the jib longitudinal axis. A deformation of the jib system transverse to the load plane in terms of the invention, which deformation is to be influenced, is achieved particularly when the jib system deviates from the desired state as a result of an external load, in particular a dynamically oscillating load to be lifted, a geometrically introduced load and/or external loads, such as wind, temperature and/or snow. In particular, deformation does not necessarily mean that a deformation is present in the jib geometry. A deformation in terms of the invention is e.g. also an arrangement deviating from the original arrangement of the jib, i.e. an inclination of the jib. A deformation in terms of the invention is also any combination or interaction of deformation and skew position. A boundary condition for the crane can also bring about a deformation transverse to the load plane of the jib system. A boundary condition is e.g. an uneven ground surface which can result in an inclination of the crane and therefore an inclination of the jib, in particular with respect to the load plane. In particular, the detection of the deformation of the jib system can include the detection of a deformation of another crane component, such as e.g. the superstructure and/or the lower carriage, wherein a deformation of the component brings about a deformation of the jib system. Detection of the deformation of the jib system can include the consideration of boundary conditions. Detection means that the deformation of the jib system is effected directly, in particular by measurement. However, the detection of the deformation also includes characteristic values being detected, with the aid of which the deformation of the jib system can be calculated or determined. In particular, the sensor unit generates a signal which can be used for further information processing. The signal-based information processing can essentially be performed in an automated manner, in particular by means of a regulating unit. In addition or alternatively, it is possible to display the deformation information which enables e.g. an operator of the crane to effect an increase in the load-bearing capacity of the crane by manual influence when a critical deformation is reached. For this purpose, the signal can be communicated to a display unit. By means of the activatable adjusting unit, additional forces, restoring forces and/or preforms of the jib system can be imposed upon the at least one crane component or parts thereof in order to influence the deformations arising from external loads, such as e.g. a lifting load, a transverse inclination of the jib as a result of a dynamic displacement of the jib and/or a wind load and/or an oblique position of the crane.

The adjusting unit is a component part of the crane. The adjusting unit serves to return a load application point towards the original load plane and in particular into the original load plane. In particular, the adjusting unit ensures that the load application point does not depart from the original load plane or the deformation of the jib system transverse to the load plane, in particular during operation of the crane, is maintained in a specifiable tolerance range. Deformations which result from load effects are thus actively counteracted.

The adjusting unit is arranged in particular between two crane components. The adjusting unit is connected directly to a first crane component and to a second crane component. By means of the deformation which is influenced, in particular reduced, by the adjusting unit, stress-loads which result from the normally occurring jib deformation are reduced and thus the load-bearing capacity of the crane is increased. The activatable adjusting unit can also be used to pre-deform the jib. This means that beforehand, before the crane, in particular the jib, is stress-loaded by an external load, a pre-deformation is imposed upon the jib in order to compensate for geometric imperfections or deformations of the jib or known external load effects directed transversely to the load plane. This improves the stability of the crane overall.

In comparison with a crane having passive system characteristics, the load-bearing capacity which can be achieved by the crane in accordance with the invention is improved. Furthermore, this means that a crane in accordance with the invention which is to have the same load-bearing capacity as a crane having passive system characteristics is of a smaller construction and in particular can be produced with a reduced material usage. This also gives rise in particular to advantages for the transportation and assembly of the crane in accordance with the invention because the number and/or size and weight of the crane components, in particular the jib, are reduced. The sensor unit and the activatable adjusting unit provide the prerequisite for a reactive crane.

A crane comprising a regulating unit which is in signal communication with the sensor unit and the adjusting unit and is intended to influence the deformation of the jib system in a regulated manner permits an automatic mode for operation of the crane with an increased load-bearing capacity. In particular, it is not necessary to involve a person who is operating the crane, although the operating conditions can change during operation of the crane, in particular wind conditions. Such a crane has an increased level of operational safety and user-friendliness. In particular, a safeguarding control and/or calculation module is integrated in the regulating unit and verifies the static and/or dynamic safety and stability of the crane, in particular on the basis of the deformation detected by means of the sensor unit. In particular, the control and/or calculation module is designed such that the risk of accidents is reduced in that critical crane operations which in particular jeopardize stability and are detected by means of the control and/or calculation module are prevented. These risks can arise e.g. from tilting of the crane and/or warping or buckling of the jib.

In addition or as an alternative to the regulating unit, a crane can have a monitoring unit, which is in signal communication with the sensor unit, for monitoring the deformation of the jib system, said monitoring unit enabling a person operating the crane to actively observe the deformations of the jib system. For example, manual influencing of the activatable adjusting unit is thereby simplified. The monitoring unit comprises in particular a camera, optical sights and/or a display element, such as e.g. a monitor.

The interaction of the sensor unit and the adjusting unit which is activated either in an automated manner via the regulating unit and/or by manual influence of an operator through the use of the monitoring unit provides a reactive crane.

A crane in which the activatable adjusting unit is arranged on the jib system can advantageously influence the deformation of the jib system transverse to the load plane itself. A hook, to which in particular a load to be lifted can be fastened, is held on the jib in particular by means of a cable.

The adjusting unit can be arranged in the lower carriage. The adjusting unit can be a component part of a floor support unit. The adjusting unit can be arranged in the superstructure, between the lower carriage and superstructure and/or between the superstructure and the jib system of the crane. In each case, the adjusting unit is arranged directly between two crane components.

A crane in which the adjusting unit for influencing the deformation of the jib system is arranged on a floor support unit of a lower carriage of the crane, in the lower carriage, between the lower carriage and a superstructure of the crane, in the superstructure and/or between the superstructure and the jib system of the crane permits flexible use of the adjusting unit, in order to counteract deformations at different points and/or on different components of the crane. In particular, it is thus possible to compensate for any twisting of the lower carriage and/or superstructure. For this purpose, e.g. the adjusting unit which can be designed in particular as an eccentric bolt or cylinder element can be arranged between the superstructure and the jib foot of the crane. The adjusting unit can be integrated as a torsion tube, which is adjustable by means of at least one cylinder, in the superstructure and/or in the lower carriage. It is also feasible to arrange the adjusting unit in the region of the rotary connection between the superstructure and the lower carriage. In particular, the adjusting unit is integrated in the rotary connection between the superstructure and the lower carriage. It is also feasible to provide the adjusting unit on a floor support unit, in order to counteract an oblique position of the lower carriage and/or the crane overall. The adjusting unit renders it possible in particular to compensate for an inclination of the crane on the ground surface. The adjusting unit can also be used in order to introduce in a targeted manner a skew position of the crane with respect to a horizontal plane. An adjusting unit which is formed between the superstructure and the jib system of the crane can be e.g. an eccentric bolt.

In particular, an inclination sensor can be integrated in an advantageous manner directly in the region of the roller rotary connection between the superstructure and lower carriage, in order to directly detect an inclination of the lower carriage with respect to a horizontal plane.

A crane in which the sensor unit has a first sensor element and a second sensor element corresponding thereto renders it possible to detect a deformation of the jib system transverse to the load plane in a simplified manner. The sensor unit can be designed as an optical measuring system. The first sensor unit can also be a laser measuring system, a radio system or a local GPS measuring system. In particular, the first and the second sensor element are attached to the crane such that a direct connecting line between the sensor elements is oriented in parallel with the jib longitudinal axis when the jib is in a non-deformed state. When the jib system is deformed, the signal transmission between the sensor elements is impaired or changed because the direct connecting line is then no longer oriented in parallel with the jib longitudinal axis. The first sensor unit can also be designed as a cable force measuring device for directly detecting a cable force in an anchoring cable.

A crane in which the sensor unit for detecting external effects comprises an inclination transducer to take into account an oblique position of the crane, an accelerometer e.g. for taking into account the circular acceleration of the jib system with respect to a lower carriage or superstructure of the crane, a wind gauge for taking into account wind loads, a force meter, a strain gauge for detecting an imposed force and/or a stress-loading of the jib system and/or a thermometer for taking into account particularly extreme ambient temperatures or temperature differences renders it possible to take into account disturbance variables caused by external loads and/or boundary conditions. The force meter and/or strain gauge can be attached e.g. to the jib system directly, in particular to a bolting arrangement of the jib system on the superstructure, for detecting a particularly unsymmetrical loading of the jib and/or can be directly attached to or integrated in the jib, in particular on chord tubes of the jib and/or on telescopic sections of the jib. The crane having the second sensor unit renders it possible to take complex load scenarios holistically into account.

A crane having at least one jib anchoring unit, which acts transversely to the load plane and/or along a jib longitudinal axis, for anchoring the jib transversely to the load plane and/or longitudinally of the jib longitudinal axis with an anchoring force permits active tractive force regulation along an anchoring element of the jib anchoring unit. For this purpose, the adjusting unit has an anchoring actuator for adapting the anchoring force. The jib anchoring unit is attached in particular to a jib system designed as a telescopic jib. By means of the jib anchoring unit, lateral anchoring is applied to the telescopic jib, in particular on both sides, i.e. the jib is pretensioned at least to a small extent on both sides. A jib which is deformed transversely to the load plane is displaced actively back in the direction of the load plane by means of a tractive force along the anchoring element. In contrast to cranes having lateral jib anchoring, as known e.g. from DE 20 2013 011 183 U1 and/or DE 20 2008 006 167 U1, the crane having the anchoring actuator renders it possible for an excessive pretensioning force in the jib anchoring unit to be omitted. The crane has, in particular, precisely two anchoring units which are arranged on both sides on the jib, in particular in a mirror-symmetrical manner with respect to the jib longitudinal axis, and are connected thereto. This means that in each case at least one anchoring unit is arranged longitudinally of the jib longitudinal axis in a lateral manner on the jib. More than two anchoring units can also be provided. The at least one jib anchoring unit, in particular the precisely two jib anchoring units, are arranged in a plane transverse, in particular perpendicular, to the luffing plane. The at least one jib anchoring unit is connected particularly firmly to the jib. An inclination of the crane such that the luffing axis is not oriented horizontally, i.e. the luffing plane is different from the load plane, ensures that two jib anchoring units, which are arranged symmetrically on the jib in relation to the jib longitudinal axis, are arranged non-symmetrically in relation to the load plane. The plane in which the jib anchoring units are arranged is spanned by the luffing axis and the jib longitudinal axis.

A crane in which the anchoring actuator is designed as a hydraulic cylinder element, as a spindle drive and/or as a force-variable or length-variable anchoring support for directly adapting the anchoring force renders it possible for the anchoring force to be adapted in a particularly advantageous manner. For example, when using an anchoring cable as an anchoring element, actively regulated cable drives can permit effective and advantageously regulatable anchoring by directly adapting the anchoring force.

In addition or as an alternative, the anchoring actuator can be designed as a displaceable articulation point of the anchoring arrangement. For this purpose, a connecting element can be designed to be displaceable so that the anchoring effect relative to the jib can be modified along the jib longitudinal axis. The connecting element is attached in particular to the jib head and/or to the jib foot. The connecting element is e.g. a sliding sleeve which can be displaced in a guided manner longitudinally of the jib. The sliding sleeve has an inner contour which corresponds to the outer contour of the jib. The sliding sleeve is e.g. a rectangular hollow profile element. Since the anchoring force acts as a tractive force along the anchoring element, a displacement of the articulation point of the anchoring element along the jib longitudinal axis of the connecting element produces a change in the angle which is formed by the line of action of the tractive force of the anchoring element and the jib longitudinal axis. Accordingly, the force component transverse to the jib longitudinal axis, i.e. transverse to the load plane, is modified. When designing a crane having a jib anchoring unit as an adjusting element, a force measuring unit which detects the cable force in the jib anchoring arrangement can be used as a sensor unit.

A crane in which the jib has a first jib portion and a second jib portion which can be displaced in particular relative to the first jib portion and in which the adjusting unit has at least one geometry actuator, which is connected to the first jib portion and to the second jib portion, for directly modifying the geometry of the jib allows the deformation to be influenced effectively. In particular, an additional jib anchoring arrangement can be omitted. However, the geometry actuator can be combined with the jib anchoring arrangement. The geometry actuator is arranged on the jib in particular in parallel with and spaced apart from the jib longitudinal axis. In particular, the geometry actuator is connected directly to the first jib portion and directly to the second jib portion and is fastened thereto. A change in length of the geometry actuator can bring about a displacement, in particular a tipping movement, of the two jib portions relative to one another. A change in length, in particular of chord tubes of a lattice mast jib, in the jib system is possible e.g. by virtue of the fact that the geometry actuator is a length-variable element, in particular a piston-cylinder unit which is actuated electrically or hydraulically. In particular, the piston-cylinder unit is dual-acting, i.e. extendible in a first direction and retractable in a second direction opposite the first direction. As a result, it is possible to lengthen and shorten the jib system in a targeted manner. A geometry actuator for effecting a change in length can also be a length-variable pressure tube which is designed as a chord tube. Such a pressure tube is a chord tube to which internal pressure is applied in particular in a hydraulic or pneumatic manner. As a result, a change in length is possible within the material limits. A change in length by means of a geometry actuator is possible e.g. also by means of an eccentric bolt which is provided at a connecting point, in particular a bolting arrangement, between two jib elements arranged one behind the other. In particular, this can effectively ensure that the line of action of the lift load remains in proximity to and in particular within the load plane of the crane. Torque loadings, in particular in the lower part of the jib which faces an articulation point of the jib on the crane, and torque loadings in the main crane itself are reduced. The crane has an increased load-bearing capacity. It is feasible to provide more than two jib portions. The jib portions are arranged in particular one behind the other along the jib longitudinal axis. In each case, two adjacent jib portions are connected to one another by means of at least one geometry actuator.

A crane having at least one joint element which connects the first jib portion and the second jib portion to one another permits a targeted and guided relative displacement of the jib portions with respect to one another. The joint element ensures the articulated connection of the two jib portions to one another. A change in length of the geometry actuator brings about an articulated relative displacement of the two jib portions. A joint axis is an axis of rotation of the relative displacement.

A crane in which the geometry actuator is designed as a cylinder element, as a spindle drive, as a linear motor, as a rack-and-pinion drive, as a lantern pinion and/or as a control element which functions so as to either act eccentrically or be based on a wedge effect permits an uncomplicated and direct relative displacement of the two jib portions.

A crane in which the jib is designed as a lattice mast jib, wherein at least portions of the geometry actuator are arranged in chord tubes of adjacent jib portions, permits a compact integration of the geometry actuator in the jib system itself. The jib has a compact construction. The required installation space is reduced.

A crane in which the adjusting unit is designed as a load application actuator, which is connected to a load application unit for the lift load and to the jib, for directly displacing the load application location on the jib allows the deformation of the jib to be influenced, in particular reduced, by means of eccentric load application. The displacement path for the load application location required for this purpose is produced by the load application actuator which facilitates the load application unit, which comprises in particular a cable roller, a cable guided via said roller and a hook block fastened thereto.

A method of influencing a deformation of a jib system of a crane in accordance with the invention comprises the method steps of detecting the deformation by means of the sensor unit and in particular actively influencing the deformation by means of the activatable adjusting unit.

The advantages of the method correspond substantially to the advantages of the crane itself, to which reference is hereby made.

A method in which a desired deformation of the jib system is calculated by means of a calculating unit permits automated monitoring of the crane during operation. The calculating unit is integrated in particular in the regulating unit. In addition, an actual deformation which has been detected by means of the sensor unit is influenced in a regulated manner. The actual deformation is influenced in a regulated manner until the desired deformation is within a specifiable, variably adjustable tolerance range. Such a method is used for detecting, displaying and/or monitoring a maximum load-bearing capacity of the crane, in particular for a person operating the crane. The person acquires an additional monitoring option. In particular, automated, regulated operation in a safe operating mode is possible.

A method in which the crane switches to a safe operating mode in the event of a failure of the sensor unit, the adjusting unit, the regulating unit and/or the monitoring unit ensures that the crane can continue to be operated in each case. Although it is feasible to equip a crane with a plurality of, in particular redundantly arranged, adjusting, sensor, regulating and/or monitoring units, in this case permanently safe crane operation would be possible in principle. However, this would mean that increased requirements upon failure safety of all of the crane functions, in particular including drive and control units are applicable. This results in increased safety outlay. It is e.g. feasible that a failure of at least one of said units results in the fact that the inventive operation of the reactive crane is no longer ensured. In particular, in a regular operation of the reactive crane in accordance with the invention, the sensor unit and/or the adjusting unit, but also the regulating unit and the monitoring unit, serve to increase the bearing load of the crane. Such an increase of the bearing load is not implemented when one of said units fails. An operating state is implemented which corresponds to that of a structurally identical crane which is not in accordance with the invention and which is thus designed in particular without a sensor unit and/or without an adjusting unit. A crane not in accordance with the invention which is not reactive cannot withstand this operating state of increased bearing load. This operating state could cause the supporting framework to collapse or could cause the crane not in accordance with the invention to tip over. Essentially, a critical operating state can occur by reason of a particularly abrupt failure of the sensor unit and/or the adjusting unit. According to the method, the occurrence of such a critical operating state is prevented such that e.g. existing load-bearing capacity tables of a structurally identical crane not in accordance with the invention are accessed. The load-bearing capacity tables can be stored e.g. in the regulating unit and/or, in the event of a failure of the regulating unit, in a central emergency control unit. The previously utilised increase in bearing load is reduced. The switch to the safe operating mode can also be effected by virtue of the fact that, in the event of a failure of at least one of said units, a person operating the crane manually influences the adjusting units such that a symmetrical loading state results. The operating safety during operation of the crane is ensured.

Exemplified embodiments of the invention will be explained in greater detail hereinafter with reference to the drawings.

DESCRIPTION OF THE PREFERRED EMBODIMENTS

Figure 1:
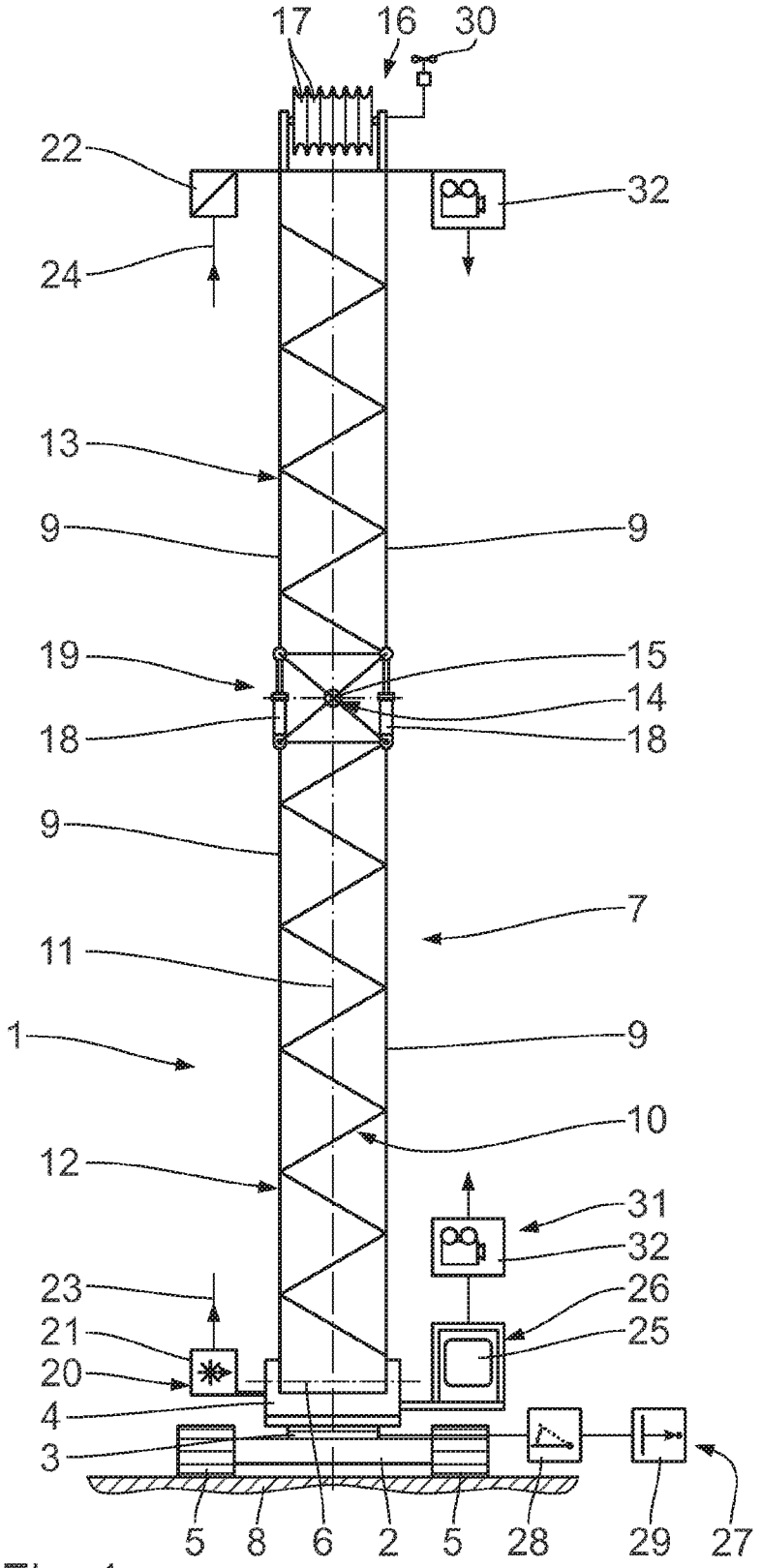
FIG. 1 shows a schematic view of a crane having a lattice mast jib and a geometric actuator.
Figure 2:
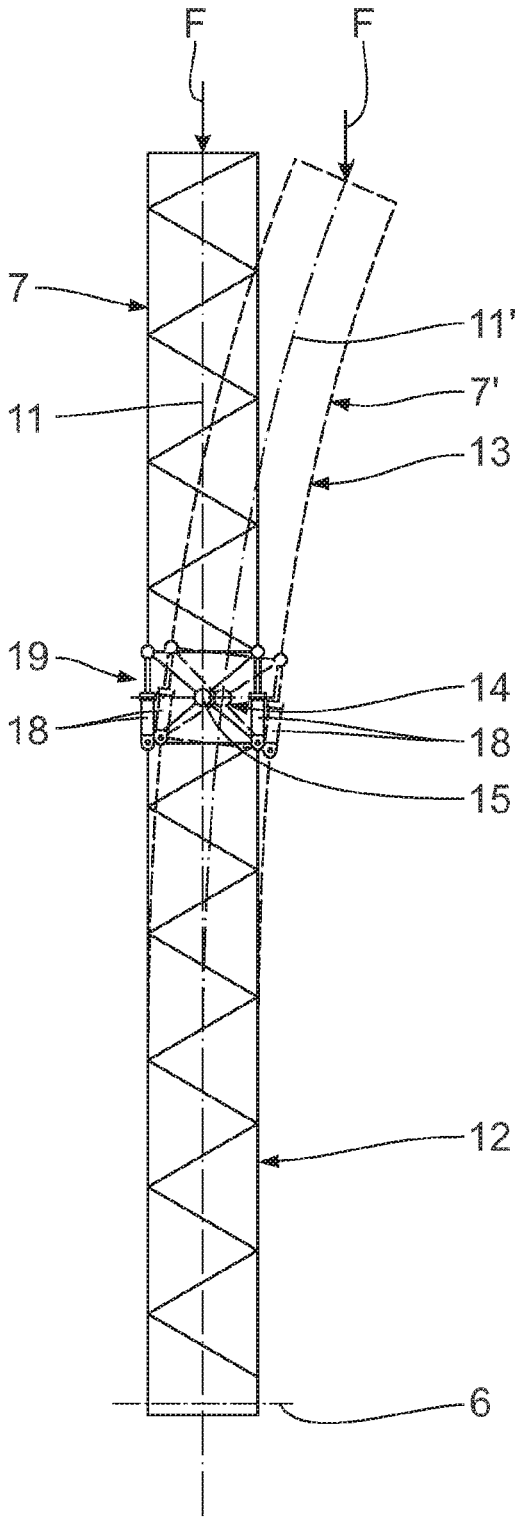
FIG. 2 shows a schematic view of the jib system shown in FIG. 1 to illustrate the deformation transverse to the load plane.
Figure 3:
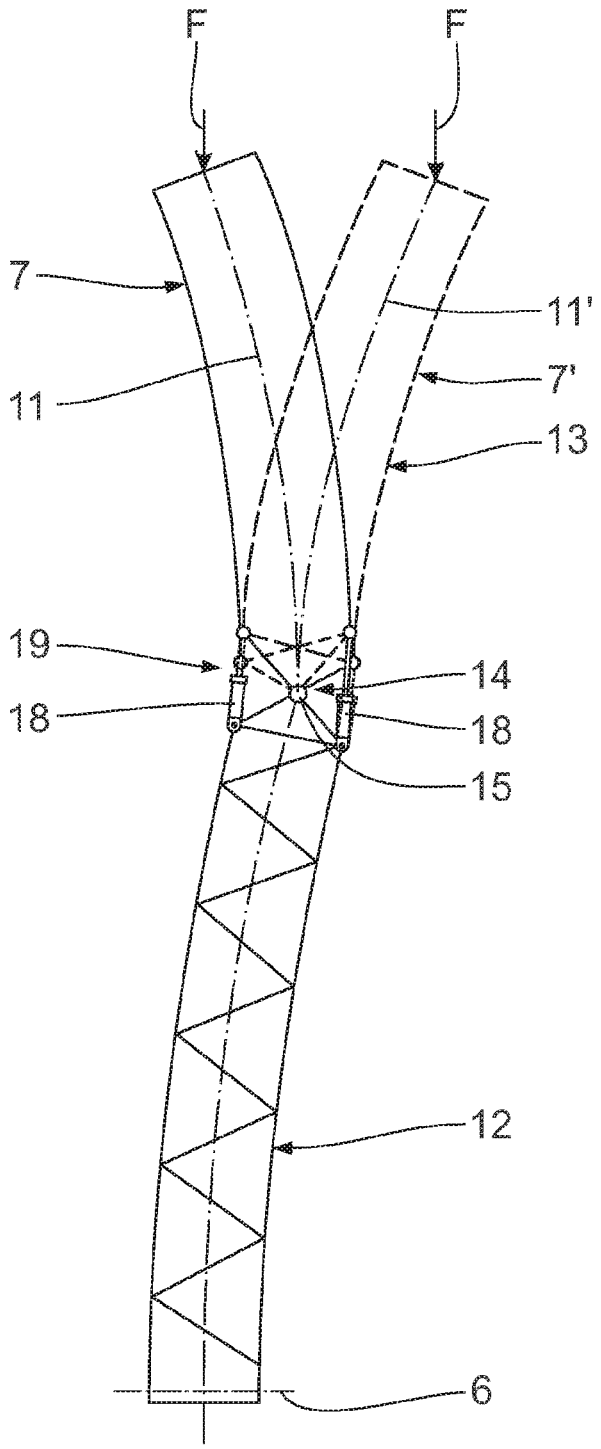
FIG. 3 shows a view of the jib system corresponding to FIG. 2 to illustrate the mode of operation of the geometry actuator.

A crane 1 which is illustrated in FIGS. 1 to 3 has a mobile lower carriage 2 and a superstructure 4 which is arranged on the lower carriage 2 in such a manner as to be able to rotate by means of a rotary connection 3. The lower carriage 2 has crawler tracks 5. The crane 1 is a crawler crane. The crane 1 can also be designed as a mobile crane suitable for use in road traffic, i.e. having rubber tyres. It is also feasible for the lower carriage 2 to be designed statically, i.e. immovably. It is also feasible for the rotary connection 3 not to be provided.

A jib 7 is articulated to the crane 1, in particular to the superstructure 4, in such a manner as to be pivotable about a jib luffing axis 6. The jib luffing axis, or luffing axis for short, is arranged in parallel with a ground surface 8, on which the crane 1 is positioned. In particular, the jib luffing axis 6 is oriented horizontally. The luffing plane is oriented perpendicularly to the luffing axis, i.e. to the plane of the drawing as shown in FIG. 1. In the event that the luffing axis 6 is oriented horizontally, the luffing plane is identical to the load plane. The luffing plane includes the jib longitudinal axis 11. The jib 7 is designed as a lattice mast jib having a plurality of, in particular four, chord tubes 9 and a reinforcing structure 10 which has diagonal bars and unstrained members. The jib 7 has, along the jib longitudinal axis 11, a first jib portion 12 and a second jib portion 13 which is connected thereto and can be displaced relative to the first jib portion 12. The two jib portions 12, 13 are substantially identical. The two jib portions 12, 13 are each arranged concentrically to the jib longitudinal axis 11 and one behind the other along the jib longitudinal axis 11. The first jib portion 12 is connected directly to the crane 1, in particular to the superstructure 4, in such a manner as to be able to pivot about the jib luffing axis 6. The region of the first jib portion 12 adjacent to the jib luffing axis 6 forms the so-called foot region of the jib 7. Opposite the foot region, the jib 7 has a head region. The head region forms an upper end of the jib 7. According to the exemplified embodiment shown, the head region is arranged on an upper end of the second jib portion 13. The first jib portion 12 and the second jib portion 13 are connected to one another by means of a joint element 14 so as to be able to pivot about a joint axis 15. The first jib portion 12 and the second jib portion 13 are connected to one another in an articulated manner. The joint axis 15 is oriented perpendicularly to the plane of the drawing shown in FIG. 1. The joint axis 15 is aligned centrally on the jib 7 in relation to the width of the jib 7. The joint axis 15 intersects the jib longitudinal axis 11. It is also feasible for the joint element 14 to be arranged eccentrically. In this case, the jib longitudinal axis 11 and the joint axis 15 are arranged in skew fashion. In particular, it is feasible for the joint element 14 to be arranged directly between two chord tubes of two adjacent jib portions. In particular, it is feasible to have a plurality of joint elements 14 which are arranged e.g. on two adjacent chord tubes of the jib portions.

Furthermore, the first jib portion 12 and the second jib portion 13 are connected to one another, in particular directly, by means of at least one geometry actuator 18. The at least one geometry actuator 18 serves to directly modify the geometry of the jib 7, in particular for relative positioning of the two jib portions 12, 13 with respect to one another. According to the exemplified embodiment shown, four geometry actuators 18 are provided. The geometry actuators 18 are arranged in extension of the respective chord tubes 9. Particularly when one or a plurality of joint elements are arranged directly on the chord tube 9, it is feasible to attach a geometry actuator to the chord tube which is arranged oppositely in each case in relation to the jib longitudinal axis. In particular, it is feasible for the geometry actuators 18 and joint elements 14 to be arranged in each case in a mirror-symmetrical manner with respect to the luffing plane. According to the exemplified embodiment shown, the geometry actuator 18 is designed as a force-variable and/or length-variable element. According to the exemplified embodiment shown, the geometry actuator 18 is a hydraulic cylinder element, wherein the cylinder housing is pivotably connected on a chord tube 9 of the first jib portion 12 arranged at the bottom. A push rod of the hydraulic cylinder element is pivotably connected to a chord tube 9 of the second jib portion 13 arranged at the top. The line of action of the geometry actuator 18 is arranged in parallel with and spaced apart from the jib longitudinal axis 11. In the non-deformed state of the jib 7 as shown in FIG. 1, the line of action of the geometry actuator 18 is in parallel with the respective chord tubes 9 of the jib portions 12, 13. The geometry actuators 18 form an adjusting unit 19. It is also feasible for the adjusting unit 19 to comprise precisely one geometry actuator 18 or more than two geometry actuators 18. The geometry actuators 18 can be actuated, i.e. are activatable. The adjusting unit 19 is activatable. The geometry actuators 18 are arranged outside the luffing plane and outside the load plane. The joint axis 15 is included in the luffing plane and in the load plane. The joint axis 15 can also be arranged outside the luffing plane and outside the load plane.

The head region of the jib 7 is provided with a load application unit 16. The load application unit 16 comprises a plurality of deflection rollers 17 and at least one lifting cable, not illustrated, and a hook, not illustrated, which is fastened thereto for lifting a load. A load being lifted causes a loading to be introduced into the jib 7.

A first sensor unit 20 for detecting a deformation of the jib 7 transverse to the load plane of the crane 1 is provided directly on the jib 7. The first sensor unit 20 comprises a first sensor element 21 and a second sensor element 22 corresponding to the first sensor element 21. The first sensor element 21 is designed as a source element, in particular as a light source. The second sensor element 22 is designed as a target element, in particular as a light detector. The second sensor element 22 serves to receive an item of information from the first sensor element 21. The sensor elements 21, 22 are attached to the jib 7 such that a source direction 23 and a target direction 24 are oriented with respect to each other in parallel and in particular in parallel with the jib longitudinal axis 11. A direct connecting line between the sensor elements 21, 22 is in parallel with the jib longitudinal axis 11. In this state, signals can be transmitted from the source element to the target element without interference.

It is also feasible for the first sensor element 21 to be a combined source/target element, i.e. a light source having an integrated light detector. In this case, the second sensor element can be designed as a light reflector. In this embodiment, the effect is identical because signals can be transmitted without interference between the two sensor elements 21, 22 only when the direct connecting line between the two sensor elements is oriented in parallel with the jib longitudinal axis 11. The sensor elements 21, 22 thus render it possible in particular to detect a deformation of the jib 7.

It is also possible to swap the arrangement of the first sensor element 21 with that of the second sensor element 22.

The first sensor unit 20 and the adjusting unit 19 are in signal communication with a central regulating unit 25 which can be integrated in a crane controller 26. Signals can be communicated via cables or wirelessly.

Furthermore, a second sensor unit 27 for detecting external effects is provided. According to the exemplified embodiment shown, an inclination sensor 28, an acceleration sensor 29 and a wind gauge 30 are combined in the second sensor unit 27. It is feasible to additionally integrate a thermometer into the second sensor unit 27. It is essential that the second sensor unit 27 measures any possibly occurring external loadings. The second sensor unit 27 is in signal communication with the regulating unit 25.

Furthermore, the crane 1 has a monitoring unit 31 which enables a crane operator to monitor the operation of the crane 1 and in particular the deformation of the jib 7 transverse to the load plane. According to the exemplified embodiment shown, the monitoring unit 31 has two cameras 32 which are attached to the jib 7 such that it is possible to monitor the jib 7 in each case starting from the foot region and from the head region. This enables a crane driver or a crane operator to see regions of the crane 1 which are not visible from the crane driver's work station. This provides the crane operator with an improved monitoring option.

For this purpose, the monitoring unit 31 has in particular a display unit, in particular in the form of a monitor, not illustrated, which is arranged in the region of the crane driver's work station.

The mode of operation of the geometry actuator 18 is illustrated in FIG. 3. A deformation of the jib system caused as a result of the load F is counteracted by means of the geometry actuators 18 by effecting a rotation of the upper jib portion 13 anticlockwise about the joint axis 15 of the joint element 14. The geometry actuator 18 illustrated on the right-hand side in FIG. 3 is extended with respect to a neutral position illustrated in FIG. 2 and/or the geometry actuator 18 illustrated on the left-hand side in FIG. 3 is retracted with respect to a neutral position illustrated in FIG. 2. The jib system is rotated with respect to the load plane, in particular until the load F is arranged on the jib longitudinal axis 11.

A method of operating the crane 1 in FIG. 1 will be explained in greater detail hereinafter with reference to FIGS. 1 to 4. The non-deformed state of the jib 7 represents the starting situation. This state is an ideal state 7 of the crane. In this state 33, the jib 7, i.e. the jib longitudinal axis 11, is linear. A loading situation of the crane 1 and in particular of the jib 7 gives rise to a deformation state 34 which deviates from the state 33. The state 33 is illustrated in FIG. 2 by a continuous line. The deformation state 34 is illustrated in FIG. 2 by a broken line. In the deformation state 34, signals from the first sensor unit 20 and the second sensor unit 27 are detected. The first sensor unit 20 provides information relating to the deformation of the jib 7 transverse to the load plane. The second sensor unit 27 provides information relating to an inclination angle of the crane 1 with respect to the horizontal, relating to a wind speed and relating to a circular acceleration of the superstructure 4 with respect to the lower carriage 2. The inclination sensor 28 can be arranged on the superstructure 4, the rotary connection 3 and/or the lower carriage 2. In particular, it is feasible for more than one inclination sensor 28 to be provided. In particular, the inclination sensor 28 can be arranged on a jib foot, i.e. in particular in the region of the jib luffing axis 6.

In particular, the acceleration sensor 29 is arranged on the superstructure 4 in order to detect the circular acceleration of the superstructure. It is feasible to arrange a plurality of acceleration sensors 29 on the superstructure 4, in particular on the jib head.

The wind gauge 30 is arranged on the jib head in order to detect the wind speed prevailing at that location.

This information and measurement values are communicated to the regulating unit 25. In a regulating/controlling step, control signals are generated by the regulating unit 25 for the adjusting unit 19 and are communicated thereto. The control signals are generated such that the deformation of the jib 7 remains as small as possible and in particular ideally disappears, i.e. is zero.

According to the exemplified embodiment shown, in the case of the deformed jib 7 an external load F acts eccentrically with respect to the jib longitudinal axis 11. A deformation of the jib 7' can also follow from a geometric imperfection or external loads. The deformation causes in particular the upper second jib portion 13 to tilt with respect to the lower first jib portion 12 about the joint axis 15. In addition, it is feasible that a deformation of the jib portions 12, 13 themselves occurs. In order to directly counteract the deformation, the control signals which have been generated during the regulating/controlling step 35 bring about an expansion, i.e. a lengthening, of the geometry actuators 18 illustrated on the right-hand side in FIG. 3, and bring about a contraction, i.e. a shortening, of the geometry actuators 18 illustrated on the left-hand side in FIG. 3. As a result, the second jib portion 13 is displaced about the joint axis 15 anticlockwise as shown in FIG. 3.

Figure 4:
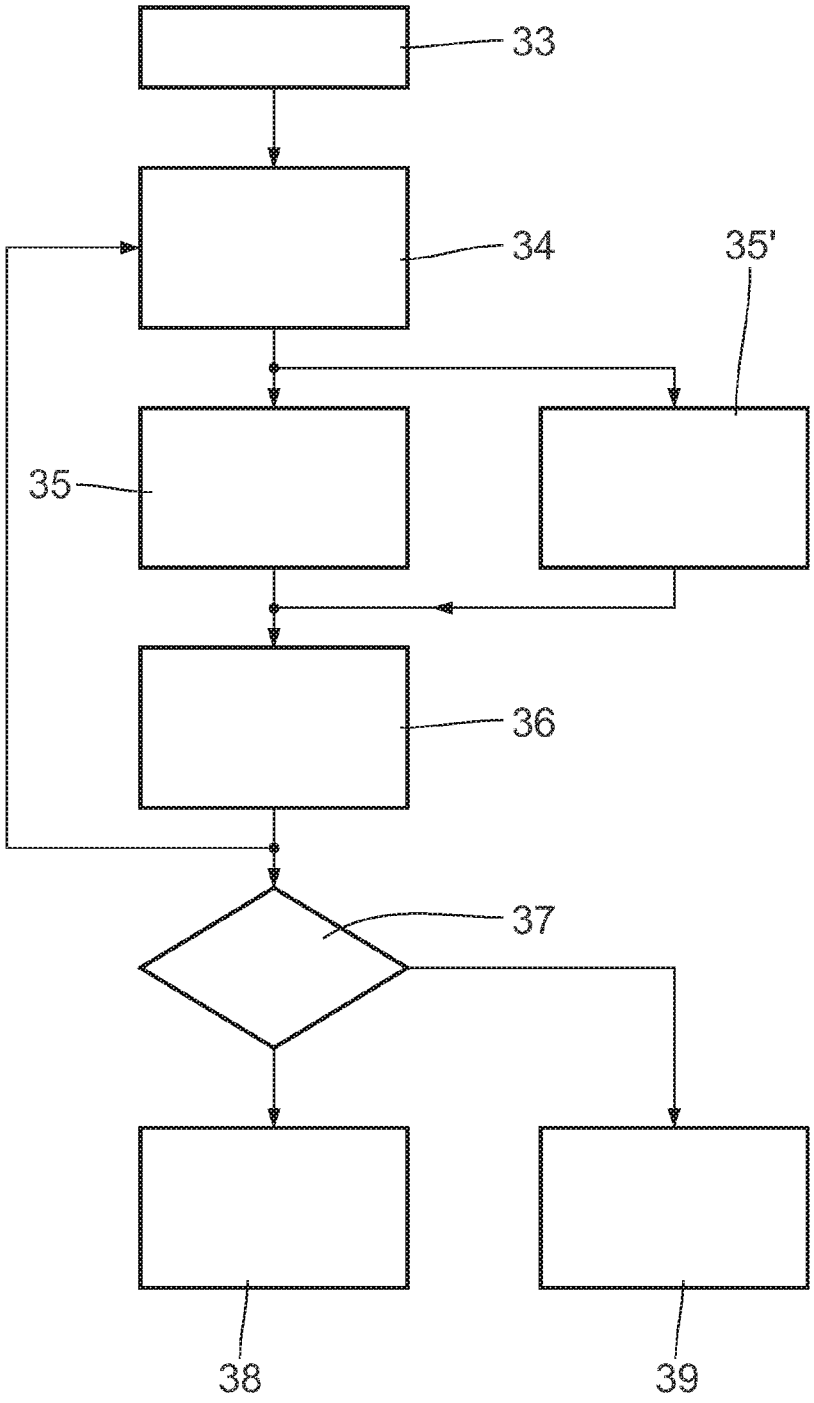
FIG. 4 shows a flow diagram to illustrate method steps for a method of operating a crane.

The jib 7 is displaced from the deformed state back to the starting state. Activation of the geometry actuators 18 brings about an active reduction in the deformation of the jib 7 transverse to the load plane. The active reduction is effected by means of the activatable adjusting unit 19. The adjusting unit 19 is activated via the regulating unit 25. It is also feasible for e.g. a crane operator to effect a manual activation of the adjusting unit 19. The reduction in the deformation of the jib 7 is illustrated in FIG. 4 by the method step 36. As an alternative to the regulating/controlling step 35, a regulating/controlling step 35' can be performed which will be explained with reference to a further embodiment. Particularly when a regulated deformation reduction is provided by means of the regulating unit 25, measurement results from the sensor units 20, 27 are constantly fed back, i.e. there is continuous monitoring of internal and external loads. This means that the method steps 34, 35 and 36 can be performed repeatedly one after the other.

The actual state of the crane 1 and in particular of the jib 7 is continuously checked in a checking step 37. If the check indicates that the actual deformation is within a specifiable, variably settable tolerance range, an increased load-bearing capacity of the crane 1 can be enabled for the operation. In this state 38, the crane 1 has an increased load-bearing capacity and thus increased functionality. If the check indicates that the jib deformation is outside the tolerance range, a standard load-bearing capacity is taken as a basis in order to operate the crane 1. In this state 39, the crane 1 corresponds to a crane which is known from the prior art and does not have an activated adjusting unit, as illustrated in FIG. 2. The increased load-bearing capacity is not enabled.

Figure 5:
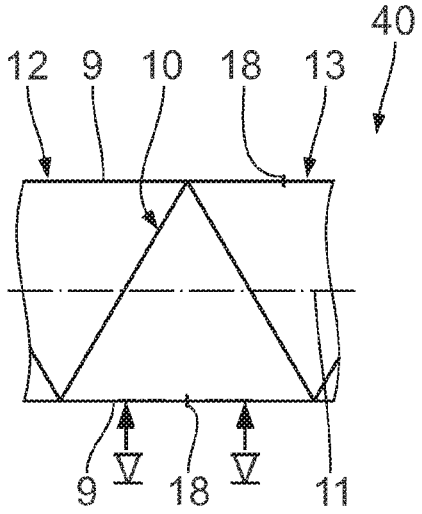
FIG. 5 shows an enlarged view of a section of a jib of a crane according to a further embodiment.
Figure 6:
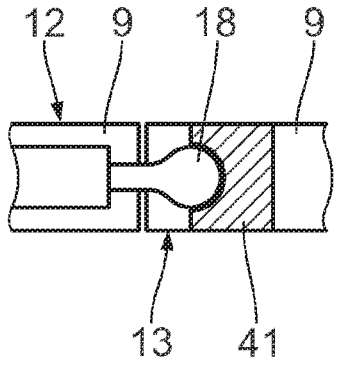
FIG. 6 shows an enlarged sectional view as per sectional line VI-VI in FIG. 5.

FIGS. 5 and 6 show a further embodiment of a jib 7 for a crane 1. Components which correspond to those already explained above with reference to FIGS. 1 to 4 are designated by the same reference numerals and are not discussed again in detail.

At least portions of the geometry actuators 40 are arranged in chord tubes 9 of adjacent jib portions 12, 13. According to the exemplified embodiment shown, the geometry actuator 18 is designed as a hydraulic cylinder element, wherein the cylinder tube is held in a stationary manner in one of the chord tubes. As shown in FIG. 6, the cylinder tube is held in the chord tube 9 illustrated on the left-hand side. The push rod of the cylinder element is held with a free end in a dedicated receptacle 41 in a stationary manner in the chord tube 9 of the second jib portion 13 illustrated on the right-hand side of FIG. 6. According to the exemplified embodiment shown, the push rod has a spherical head-shaped ending. Accordingly, the receptacle 41 is formed with a recess corresponding to the spherical head-shaped ending. The push rod is fixed in the receptacle 41 in relation to a longitudinal displacement along the chord tubes 9. The push rod is arranged in an articulated manner in the receptacle 41. A change in the length of hydraulic cylinder element ensures a direct change in the geometry of the jib 7.

In the case of the lattice mast jib 7, it is feasible to effect a deformation without a joint, i.e. without an articulated arrangement of the push rod in the receptacle 41 in that a multiplicity of geometry actuators 40 designed as short stroke actuators are provided. Each individual short stroke actuator produces comparatively small deformations which are within the material limits. The articulated arrangement is advantageous for comparatively large displacement paths. In addition or as an alternative, other construction principles can be used, such as a tube connection which does not act as a frame corner.

Figure 7:
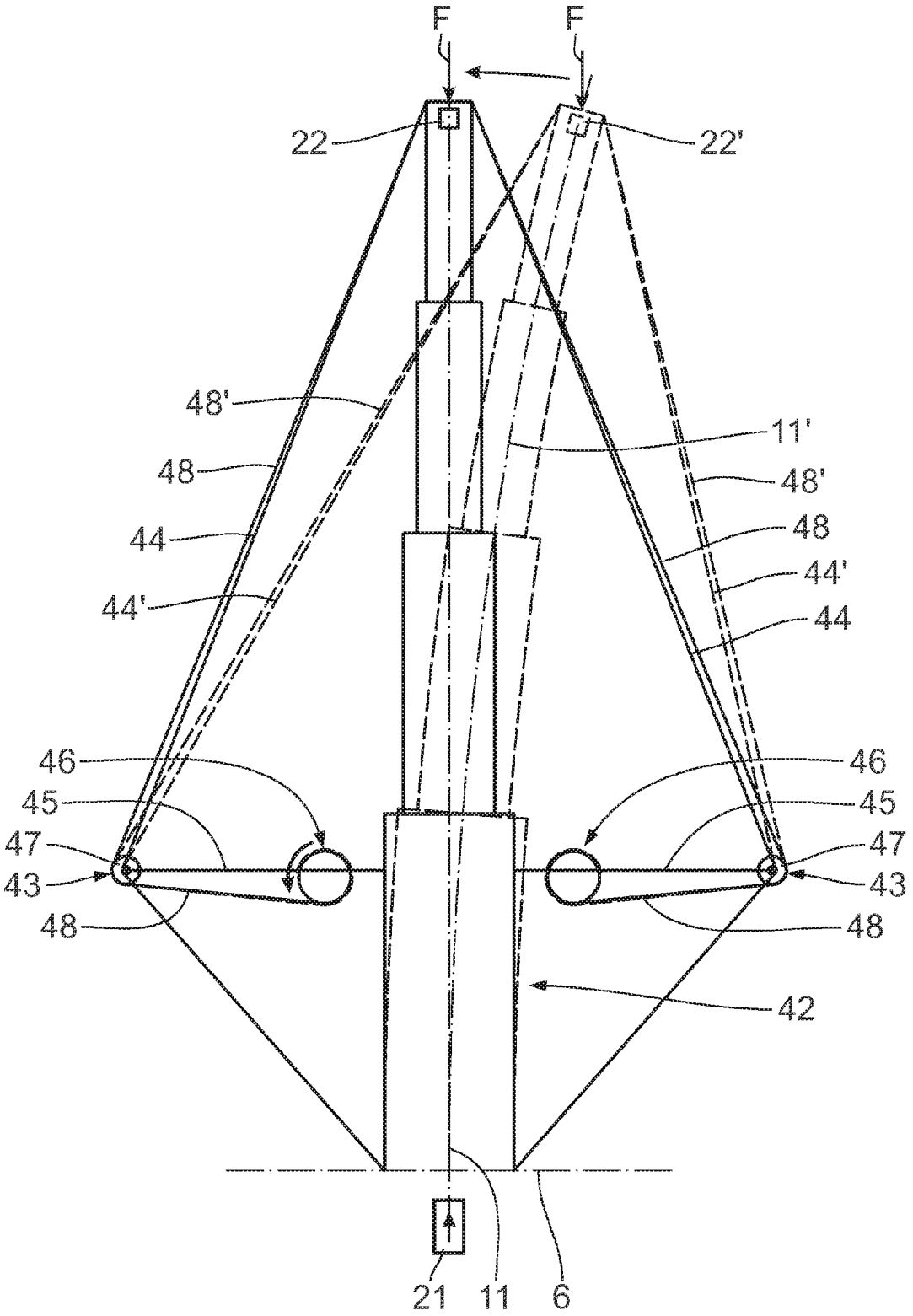
FIG. 7 shows a view of a jib of a crane corresponding to FIG. 2 according to a further embodiment having lateral jib anchoring units and anchoring actuators.

FIG. 7 shows a further embodiment of an adjusting unit for a crane. Components which correspond to those already explained above with reference to FIGS. 1 to 6 are designated by the same reference numerals and will not be discussed again in detail.

The jib 42 has two lateral anchoring units 43. The anchoring units 43 serve to anchor the jib 42 transversely to the load plane with an anchoring force which acts in particular as a tractive force along an anchoring element of a lateral jib anchoring unit 43. The lateral jib anchoring units 43 are arranged axially symmetrically with respect to the jib longitudinal axis 11. Such jib anchoring units 43 are known per se from DE 20 2008 006 167 U1, to which reference is made in relation to details of the lateral jib anchoring units 43.

The jib anchoring units 43 have anchoring elements 44 which are each articulated in the head region and in the foot region of the jib 42. The anchoring elements 44 are each guided between the head region and the foot region of the jib 42 via an anchoring support 45. The jib 42 is a telescopic jib.

The adjusting unit 19 has two anchoring actuators 46 which are provided for increasing the anchoring force. The anchoring actuators 46 are designed as cable winches which are arranged fixedly on the jib 42 and in particular on the largest telescopic tube. The cable 48 of the cable winch is guided to the head region of the jib 42 via a deflection roller 47 which is fastened in particular to the anchoring support 45.

As a result of an external loading F and/or as a result of disruptive influences, the jib 42 can deform and have a non-linear jib longitudinal axis 11'. The deformed state of the jib 42 is illustrated in FIG. 7 by a broken line. In this state, signals can no longer be transmitted between the sensor elements 21 and 22' of the first sensor unit 20 without interference. By reason of this, the regulating unit 25 causes a control signal for the adjusting unit 19, in particular for the anchoring actuator 46 in the form of the cable winch, as illustrated on the left-hand side of FIG. 7. The cable winch is driven, anticlockwise as shown in FIG. 7, such that the cable 48 is rolled up onto the cable winch. As a result, the tractive force in the cable 48 which is guided in parallel with the anchoring element 44 is increased. The jib 42 is pulled back in the head region to the ideal position, to the left as shown in FIG. 7. This means that the regulating unit 25 acts upon the anchoring actuators 46 such that the deformation of the jib transverse to the load plane is optimised with respect to the effective loads and preforms. This method step is designated in FIG. 4 by the reference numeral 35'.

Figure 8:
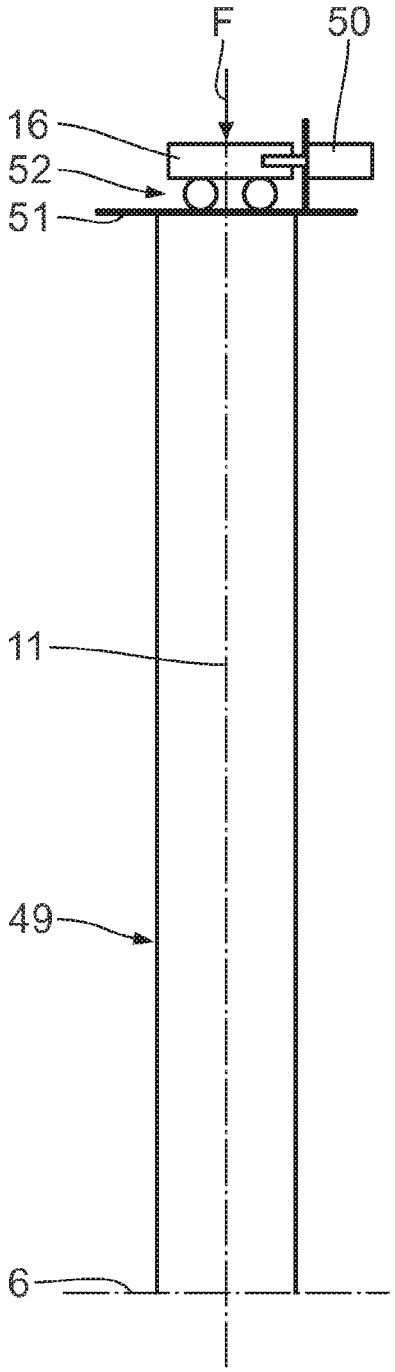
FIG. 8 shows a view of a jib of a crane corresponding to FIG. 2 according to a further embodiment having a load application actuator.
Figure 9:
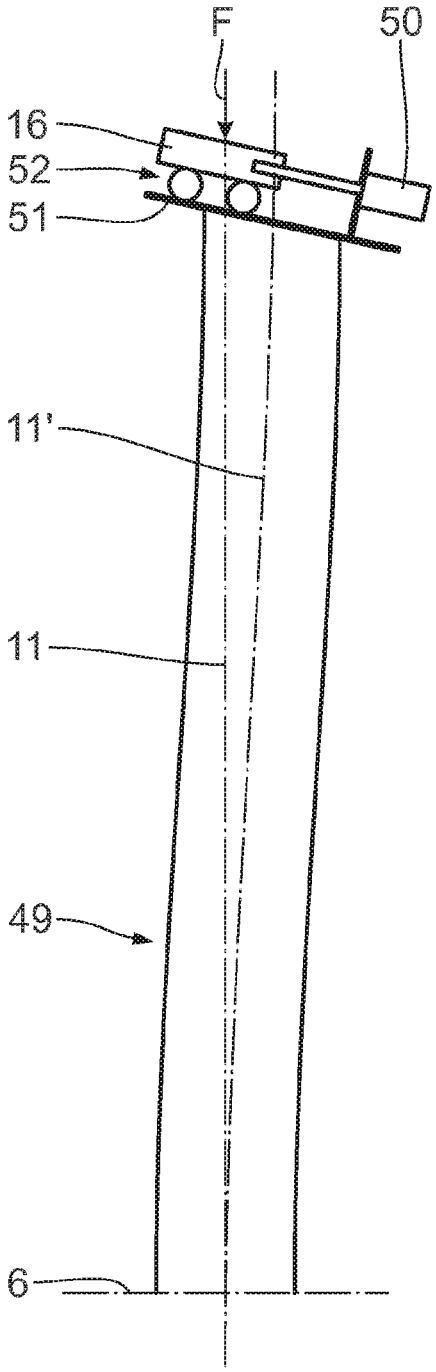
FIG. 9 shows a front view of the jib corresponding to FIG. 8.

FIGS. 8 and 9 show a further embodiment of an adjusting unit of a crane. Components which correspond to those already explained above with reference to FIGS. 1 to 7 are designated by the same reference numerals and will not be discussed again in detail.

The substantial difference with respect to the foregoing embodiments is that the adjusting unit 19 has a load application actuator 50 which is connected to the load application unit 16 and the jib 49. This renders it possible for the load application unit 16, in particular the deflection rollers 17 arranged on the head region of the jib 49, to be displaceable relative to the jib 49, in particular transversely to the load plane. For this purpose, the load application actuator 50 which is designed as a force-variable and/or length-variable element is fixedly fastened with the jib 49, in particular in a dedicated holder 51, to the head region of the jib 49. The load application unit 16 is displaceable in a manner guided along a guide system 52 transversely to the load plane on the jib 49. According to the exemplified embodiment shown, the guide system 52 has rails, along which the load application unit 16 can be displaced in a manner guided on rollers. The load application actuator 50 serves to directly displace the load application location on the jib 49. According to the exemplified embodiment shown, the load application actuator 50 is designed as a hydraulic cylinder element.

During a deformation of the jib 49, the load application actuator 50 and the holder 51 are jointly displaced. In order to prevent the load application unit 16 from also being displaced eccentrically, the load application actuator 50 can be activated by being extended such that the load application unit 16 is displaced back in the direction of the ideal position. In the case of this exemplified embodiment, a deformation of the jib 49 itself is knowingly tolerated as long as the load application location is in a specified tolerance range.

Figure 10:
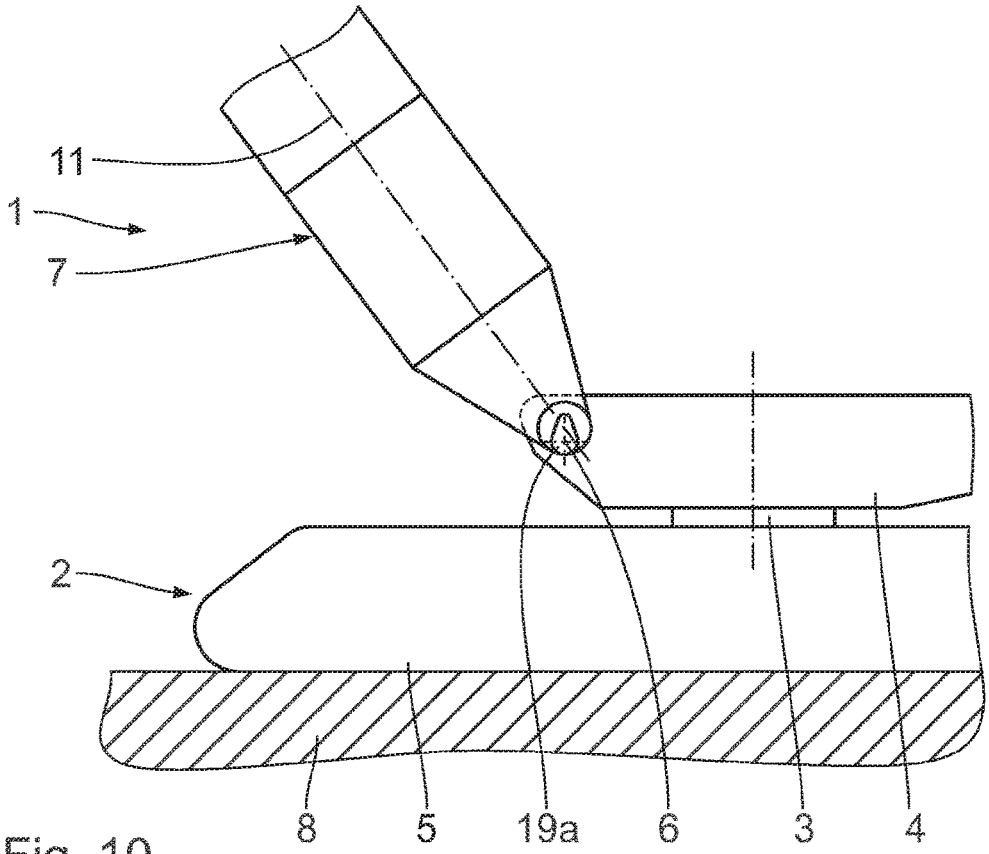
FIG. 10 shows a schematic side view of the crane shown in FIG. 1 having further adjusting units.

FIG. 10 shows a side view of the crane 1 shown in FIG. 1. It is apparent therefrom that a further adjusting unit **19*a* is attached directly between the superstructure 4 and the jib 7. By means of the adjusting unit 19*a* it is possible to change the inclination angle of the luffing axis 6 with respect to the horizontal. In particular, the adjusting unit 19*a* acts upon the foot of the jib 7. The adjusting unit 19*a* comprises at least one, in particular two, eccentric bolts, in particular two eccentric bolts are thus provided along the luffing axis 6 on the foot bearings of the jib 7 in order to connect it to the superstructure 4. The eccentric bolts have a cross-sectional area with respect to the luffing axis 6 which is eccentric in relation to the luffing axis 6. By rotating the eccentric bolt about the luffing axis 6, the inclination of the luffing axis with respect to the horizontal can be influenced. As a result, it is possible to influence an inclination of the jib 7 transverse to the load plane. Rotation of the eccentric bolt results in an oblique position, i.e. an inclination, of the jib foot transverse to the load plane. In particular, it is possible, e.g. by rotating two eccentric bolts in opposite directions, to achieve a horizontal alignment of the luffing axis when the superstructure 4** is arranged in an inclined manner.

Figure 11:
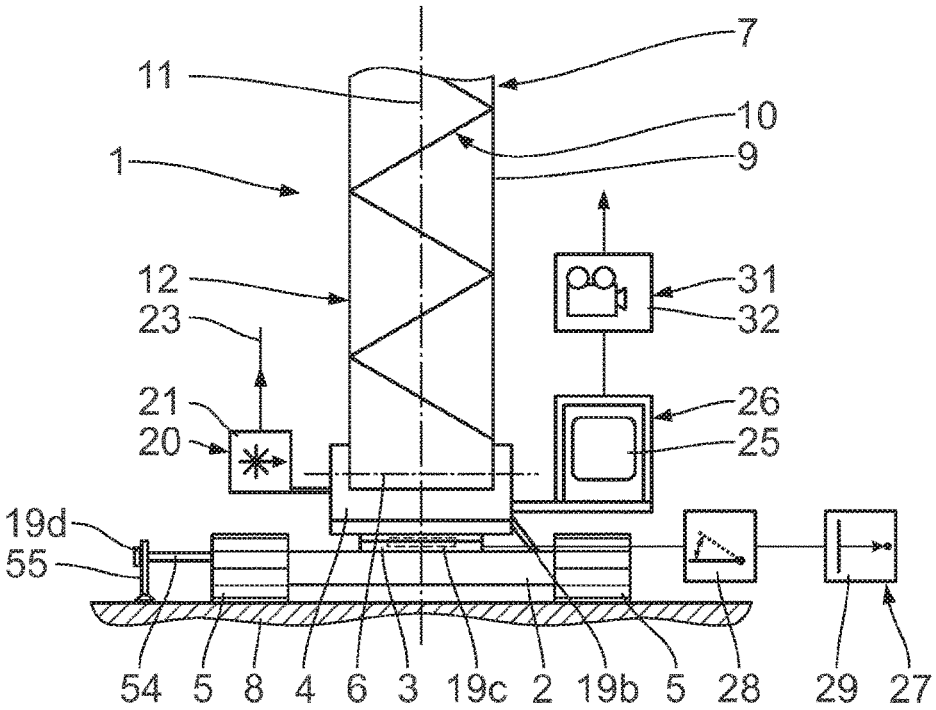
FIG. 11 shows an enlarged detailed view shown in FIG. 1 to illustrate a further adjusting unit.

FIG. 11 shows an enlarged detailed view of the crane shown in FIG. 1. FIG. 11 illustrates a further adjusting unit 19*b* which is arranged directly between the lower carriage 2 and the superstructure 4. The lower carriage 2 and superstructure 4 are connected directly to one another by means of the adjusting unit 19*b*. The adjusting unit 19*b* is arranged independently of the rotary connection 3 between the superstructure 4 and lower carriage 2. The adjusting unit 19*b* permits a relative displacement between the superstructure 4 and lower carriage 2.

In addition or as an alternative, a further adjusting unit 19*c*, which is indicated in FIG. 11 by a broken line, can be integrated in the rotary connection 3 in order to permit a relative displacement, in particular influencing of the inclination of the jib longitudinal axis 11 with respect to the ground surface 8.

FIG. 11 illustrates a floor support unit in a purely schematic manner. The floor support unit comprises a substantially horizontal support carrier 54 and a substantially vertically arranged support cylinder 55. A plurality of floor support units can be arranged on the crane. The floor support units are connected in particular to the lower carriage 2 and/or to the superstructure 4. According to the exemplified embodiment shown, a further adjusting unit 19*d* is provided on the floor support unit. According to the exemplified embodiment shown, the further adjusting unit 19*d* is attached laterally to the support cylinder 55. By means of this adjusting unit 19*d* it is possible to adapt an inclination of the crane 1, in particular of the lower carriage 2 with respect to the floor 8, such that the load plane is vertically oriented. This means that the luffing axis 6 is horizontally oriented.

The invention claimed is:

1. A crane, said crane comprising:

a jib system;

a sensor unit operable to detect a deformation of the jib system transverse to a load plane; and an activatable adjusting unit configured to influence the deformation of the jib system transverse to the load plane;

wherein a regulating unit and/or a monitoring unit is provided, with said regulating unit being in signal communication with the sensor unit and with the adjusting unit and configured to influence the deformation of the jib system in a regulated manner transverse to the load plane, and with said monitoring unit being in signal communication with the sensor unit and operable to monitor the deformation of the jib system transverse to the load plane, and wherein the adjusting unit has a load application actuator, which is connected to a load application unit and the jib for directly displacing deflection rollers arranged on a head region of the jib.

2. The crane system as claimed in claim 1, wherein the load application actuator is designed as a cylinder element, spindle drive, linear motor or lantern pinion.

3. The crane as claimed in claim 1, wherein the sensor unit has a first sensor element and a second sensor element corresponding thereto.

4. The crane as claimed in claim 3, wherein a direct connecting line between the first sensor element and the second sensor element is oriented in parallel with the jib longitudinal axis when the jib is in a non-deformed state.

5. The crane as claimed in claim 1, wherein the sensor unit detects external effects.

6. The crane as claimed in claim 5, wherein the sensor unit comprises an inclination transducer, an accelerometer, a wind gauge, a strain gauge, a force meter and/or a thermometer.

7. The crane as claimed in claim 1, wherein a jib anchoring unit is provided which acts transversely to the load plane and/or along a jib longitudinal axis, wherein the adjusting unit has an anchoring actuator for adapting the anchoring force.

8. The crane as claimed in claim 7, wherein the anchoring actuator is designed as a cable winch, a cylinder element, a spindle drive, a force-variable or a length-variable anchoring support and/or as an articulation point of the anchoring arrangement which can be displaced longitudinally of the jib longitudinal axis.

9. The crane system as claimed in claim 1, wherein the load application actuator is arranged in the head region of the jib.

* * * * *